US011067270B1

(12) United States Patent
Oyepeju

(10) Patent No.: US 11,067,270 B1
(45) Date of Patent: Jul. 20, 2021

(54) FLIP-UP LIGHT FOR A REMOTE CONTROL

(71) Applicant: Oyediran Adeyemi Oyepeju, Coventry (GB)

(72) Inventor: Oyediran Adeyemi Oyepeju, Coventry (GB)

( * ) Notice: Subject to any disclaimer, the term of this patent is extended or adjusted under 35 U.S.C. 154(b) by 0 days.

(21) Appl. No.: 16/882,632

(22) Filed: May 25, 2020

(51) Int. Cl.

| | |
|---|---|
| ***F21V 33/00*** | (2006.01) |
| ***F21V 21/30*** | (2006.01) |
| ***F21V 23/04*** | (2006.01) |
| ***F21V 23/06*** | (2006.01) |
| ***F21S 8/00*** | (2006.01) |
| ***F21S 9/02*** | (2006.01) |
| *F21Y 115/10* | (2016.01) |

(52) U.S. Cl.
CPC ..... *F21V 33/0052* (2013.01); *F21S 8/03* (2013.01); *F21S 9/02* (2013.01); *F21V 21/30* (2013.01); *F21V 23/0471* (2013.01); *F21V 23/06* (2013.01); *F21Y 2115/10* (2016.08)

(58) Field of Classification Search
CPC ..... F21S 8/03; F21S 9/02; F21V 23/0471; F21V 23/06; F21V 21/30; F21V 33/0052
See application file for complete search history.

(56) References Cited

U.S. PATENT DOCUMENTS 5,172,974 A * 12/1992 Riban ..... F21V 33/0052 362/109
8,888,309 B1 * 11/2014 Foo ..... A45C 11/00 362/98
2014/0307460 A1 * 10/2014 Li ..... B60Q 1/2615 362/523
2017/0049204 A1 * 2/2017 Valkenhoff ..... A45C 13/1069

* cited by examiner

*Primary Examiner* — Rajarshi Chakraborty
*Assistant Examiner* — Nathaniel J Lee

(57) ABSTRACT

A portable lamp for affixing with an object, such as a remote control, includes a base that has a raised pivot pin. An enclosure has a pivot pin receiving recess adapted for receiving the pivot pin of the base pivotally therein. The enclosure includes an opening on a lower side thereof and a circuit board that includes a lighting circuit having a plurality of LEDs aligned with the opening of the lower side of the enclosure, a battery, and a magnetic switch disposed within the enclosure adjacent to at least one magnet of the base when the base and the enclosure are mutually aligned. In use, with the base affixed with the object and with the base aligned with the enclosure, the lighting circuit maintains the LEDs in an off state. With the enclosure manually pivoted away from the base the lighting circuit illuminates the LEDs.

1 Claim, 4 Drawing Sheets

FLIP-UP LIGHT FOR A REMOTE CONTROL

STATEMENT REGARDING FEDERALLY SPONSORED RESEARCH AND DEVELOPMENT

Not Applicable.

FIELD OF THE INVENTION

This invention relates to portable lighting devices, and more particularly to a portable LED lamp for illuminating remote controls.

BACKGROUND

Remote controls, restaurant bill portfolios, video game controllers, and like objects that take visual acuity to use are often found in dark lighting conditions. As such, it is often difficult to see what buttons to push on such a remote control, for example, without additional lighting. In some cases the remote controls are equipped to illuminate their keys, but often the text around such keys can still not be read in lower lighting conditions.

Therefore, there is a need for a device that is a convenient lamp for illuminate a remote control keyboard, or the like. Such a needed invention would be relatively simple to adhere to an object, and would provide a rechargeable battery for efficiency and ease-of-use. Such a needed invention would be discrete and intuitive to operate. The present invention accomplishes these objectives.

SUMMARY OF THE INVENTION

The present device is a portable lamp for affixing with an object, such as a remote control, restaurant check portfolio, portable calculator or the like, for the purpose of selectively illuminating the object.

An elongated base has at a first end a raised pivot pin. The base further includes one or more magnet recesses, each adapted for receiving a magnet therein. Preferably a lower side of the elongated base includes a double-sided adhesive tape, such that the base may be mounted to the object.

An elongated enclosure has at a first end a pivot pin receiving recess adapted for receiving the pivot pin of the elongated base pivotally therein. The enclosure includes an opening on a lower side thereof. Preferably the enclosure includes two opposing side walls, each of which further includes a glow-in-the-dark luminescent material.

The circuit board includes a lighting circuit having a plurality of LEDs aligned with the opening of the lower side of the enclosure. The lighting circuit further includes a battery, and a magnetic switch disposed within the enclosure adjacent to the at least one magnet of the elongated base when the base and the enclosure are mutually aligned. The magnetic switch is normally-open when in proximity to the at least one magnet.

In use, with the base affixed with the object and with the base aligned with the enclosure, the lighting circuit maintains the LEDs in an off state. With the enclosure manually pivoted away from the base, the magnetic switch loses proximity with the at least one magnet and the lighting circuit illuminates the LEDs in an on state.

Preferably the battery is a rechargeable battery, in which case the lighting circuit further includes a recharging port adjacent a recharging port apertures in the enclosure, such that a power source plugged into the recharging port recharges the battery. Such a power source may be a USB cable connected with a laptop computer, an AC adapter, or the like, for example. Further, in such an embodiment the lighting circuit further preferably includes a recharging LED adapted to illuminate whenever the power source is connected with the recharging port and the battery is recharging.

Preferably the base further includes a detent track and the enclosure further includes a resilient split detent pin that is adapted to engage the detent track e as the enclosure pivots around the pivot pin of the base. The detent track preferably includes two or more detent recesses for receiving the split detent pin therein at discrete rotational positions between the base and the enclosure, providing tactile feedback to a user as to the rotational position of the enclosure with respect to the base. The detent pin, when engaged with the detent recesses serve to maintain the enclosure at a fixed rotational position with respect to the elongated base so that the enclosure may be released by the user in the on state, the user then free to use the remote control object or the like.

The present invention is a convenient lamp for illuminate a remote control or the like. The present device is relatively simple to adhere to an object, and provides a rechargeable battery for efficiency and ease-of-use. The present invention is discrete and intuitive to operate. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a portable lamp 10 for affixing with an object 20, such as a remote control, restaurant check portfolio (not shown), portable calculator (not shown) or the like, for the purpose of selectively illuminating the object 20.

Figure 5:
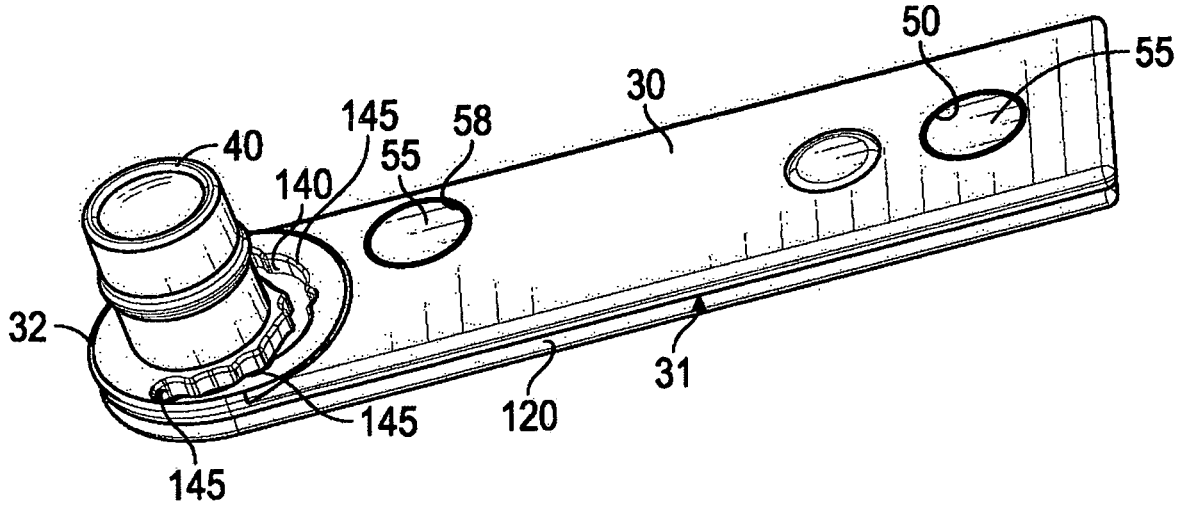
FIG. 5 is a top perspective view of an elongated base of the invention.

An elongated base 30 has at a first end 32 a raised pivot pin 40. The base 30 further includes one or more magnet recesses 50, each adapted for receiving a magnet 55 therein (FIG. 5). Preferably a lower side 31 of the elongated base 30 includes a double-sided adhesive tape 120, such that the base 30 may be mounted to the object 20. Alternately, instead of double-sided adhesive tape 120, another two-part mechanical fastener (not shown) may be utilized, such as hook-and-loop type mechanical fastening tape, magnetic attraction, a temporary adhesive gel, or the like. The elongated base 30 is preferably made from a rigid or semi-rigid injection molded plastic material.

Figure 1:
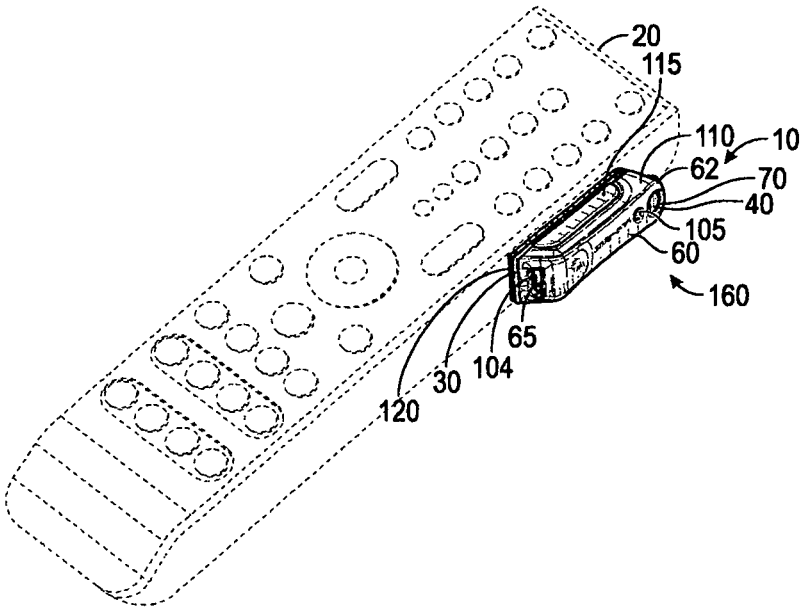
FIG. 1 is a perspective view of the invention, illustrated in an off state and as attached to a remote control object.
Figure 2:
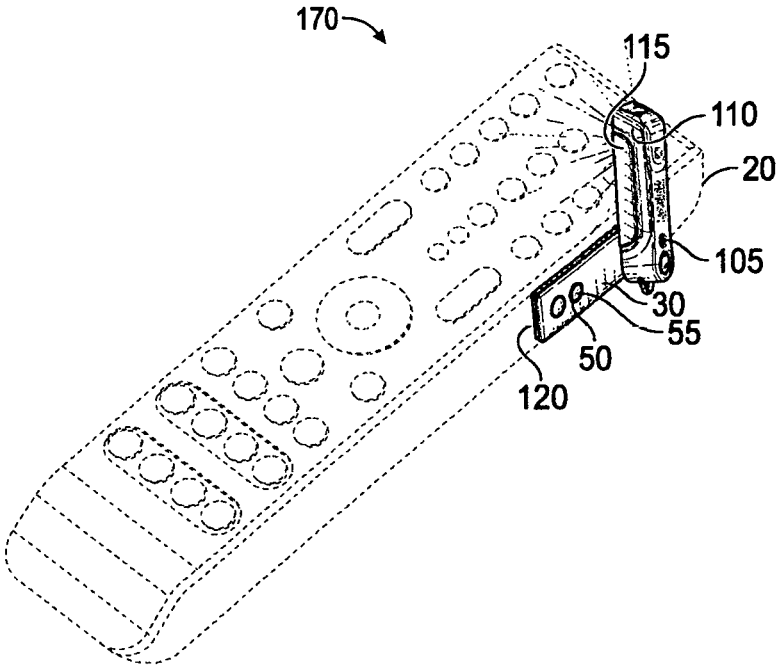
FIG. 2 is a perspective view of the invention, illustrated in an on state to illuminate the remote control.
Figure 3:
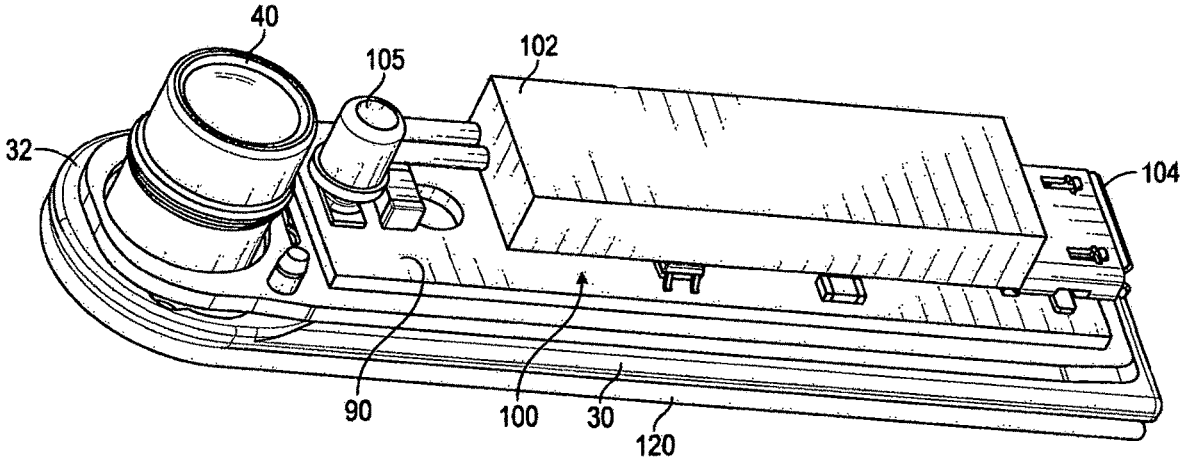
FIG. 3 is a top perspective view of the invention, illustrated with an enclosure of the invention omitted for clarity of illustration.
Figure 4:
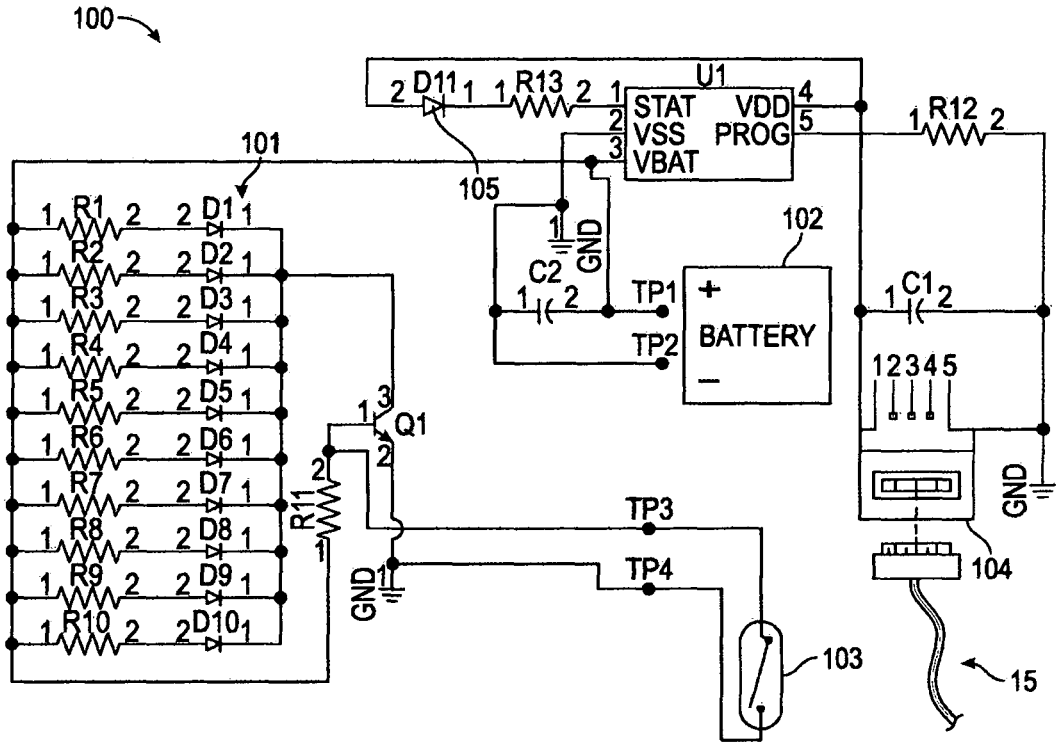
FIG. 4 is a schematic diagram of one embodiment of the invention.
Figure 6:
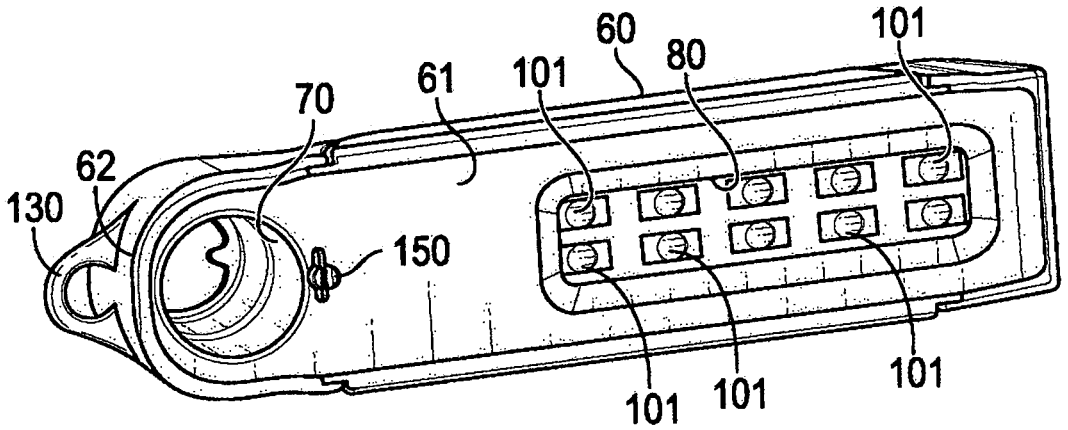
FIG. 6 is a bottom perspective view of the enclosure of the invention.

An elongated enclosure 60 has at a first end 62 a pivot pin receiving recess 70 adapted for receiving the pivot pin 40 of the elongated base 30 pivotally therein. The enclosure 60 includes an opening 80 (FIG. 6) on a lower side 61 thereof. Preferably the enclosure 60 includes two opposing side walls 110, each of which further includes a glow-in-the-dark luminescent material 115 (FIGS. 1 and 2). In some embodiments the enclosure includes a key ring 130 projecting away from the enclosure 60, such that the portable lamp 10 may be carried in a pocket or purse, for example. The enclosure 60 is preferably made from a rigid or semi-rigid injection molded plastic material, and the lower side 61 may be an inserted piece that traps a circuit board 90 within the enclosure 60 when assembled.

The circuit board 90 includes a lighting circuit 100 (FIG. 4) having a plurality of LEDs 101 aligned with the opening 80 of the lower side 61 of the enclosure 60. The lighting circuit 100 further includes a battery 102, and a magnetic switch 103 disposed within the enclosure 60 adjacent to the at least one magnet 55 of the elongated base 30 when the base 30 and the enclosure 60 are mutually aligned (FIG. 1). The magnetic switch 103, sometimes referred to as a "reed switch," is normally open when in proximity to the at least one magnet 55.

In use, with the base 30 affixed with the object 20 and with the base 30 aligned with the enclosure 60, the lighting circuit 100 maintains the LEDs in an off state 160 (FIG. 1). With the enclosure manually pivoted away from the base 30, the magnetic switch 103 loses proximity with the at least one magnet 55 and the lighting circuit illuminates the LEDs in an on state 170 (FIG. 2).

Preferably the battery 102 is a rechargeable battery 102, in which case the lighting circuit 100 further includes a recharging port 104 adjacent a recharging port apertures 65 in the enclosure 60, such that a power source 15 (FIG. 4) plugged into the recharging port 104 recharges the battery 102. Such a power source 15 may be a USB cable connected with a laptop computer, an AC adapter, or the like, for example. Further, in such an embodiment the lighting circuit 100 further preferably includes a recharging LED 105 adapted to illuminate whenever the power source 15 is connected with the recharging port 104 and the battery 102 is recharging.

Preferably the base 30 further includes a detent track 140 and the enclosure further includes a resilient split detent pin 150 that is adapted to engage the detent track e 140 as the enclosure 30 pivots around the pivot pin 40 of the base 30. The detent track 140 preferably includes two or more detent recesses 145 for receiving the split detent pin therein at discrete rotational positions between the base 30 and the enclosure 60, providing tactile feedback to a user (not shown) as to the rotational position of the enclosure 60 with respect to the base 30. The detent pin 150, when engaged with the detent recesses 145 serve to maintain the enclosure 60 at a fixed rotational position with respect to the elongated base 30 so that the enclosure 60 may be released by the user in the on state, the user then free to use the remote control object 20 or the like.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A portable lamp for affixing with an object, comprising:

an elongated base having at a first end a raised pivot pin, the base further including a lower side fixed with a double-sided adhesive tape, a detent track, and one or more magnet recesses, each magnet recess for receiving a magnet therein;

an elongated enclosure having at a first end a pivot pin receiving recess adapted for receiving the pivot pin of the elongated base pivotally therein, the enclosure including an opening on a lower side thereof, a key ring projecting away from the enclosure, two opposing side walls, each side wall further including a glow-in-the-dark luminescent material, and a resilient split detent pin adapted to engage the detent track of the base as the enclosure pivots around the pivot pin of the base, the detent track including two or more detent recesses for receiving the split detent pin therein;

a circuit board embodying a lighting circuit having a plurality of LEDs aligned with the opening of the lower side of the enclosure, a rechargeable battery, a recharging port adjacent a recharging port aperture in the enclosure, a recharging LED, and a magnetic switch disposed within the enclosure adjacent to the at least one magnet of the elongated base when the base and the enclosure are mutually aligned, the magnetic switch normally open when in proximity to the magnet;

whereby with the base affixed with the object by the double-sided adhesive tape, and with the base aligned with the enclosure, the lighting circuit maintains the LEDs in an off state, and wherein with the enclosure pivoted away from the base, the magnetic switch loses proximity with the at least one magnet and the lighting circuit illuminates the LEDs, and wherein with a power source plugged into the recharging port, the battery is recharged by the power source and the lighting circuit illuminates the recharging LED.

* * * * *